United States Patent [19]

Flaugnatti

[11] 3,942,023

[45] Mar. 2, 1976

[54] RADIOLOGICAL PROTECTIVE SCREEN

[76] Inventor: Richard Bruno Flaugnatti, 13, rue Racine, 76 Saint-Etienne Du Rouvray, France

[22] Filed: Dec. 27, 1973

[21] Appl. No.: 428,776

[30] Foreign Application Priority Data

Dec. 28, 1972 France ..... 72.46742

[52] U.S. Cl. ..... 250/515; 250/519

[51] Int. Cl. ..... G21f 3/00

[58] Field of Search ..... 250/510, 515, 518, 519, 250/516, 517; 252/478

[56] References Cited

UNITED STATES PATENTS

| | | | |
|---|---|---|---|
| 1,748,403 | 2/1930 | Wentworth | 250/516 |
| 3,715,587 | 2/1973 | Burkhalter et al. | 250/510 |
| 3,818,234 | 6/1974 | Atkins et al. | 250/518 X |

*Primary Examiner*—James W. Lawrence
*Assistant Examiner*—Davis L. Willis

[57] ABSTRACT

A radiological screen for placing on a patient's skin comprising a flat jacket containing a fine particulate filler and a settable resin binder, the fine particulate filler being of a material which absorbs medical radiation, and the jacket including a window to transmit such radiation through the flat jacket.

16 Claims, 4 Drawing Figures

RADIOLOGICAL PROTECTIVE SCREEN

Figure 1:
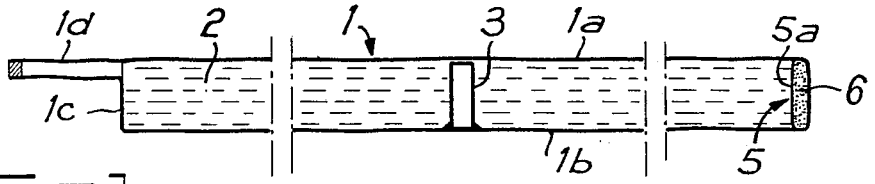

The present invention relates to a protective screen based on mortar, used in the field of radiology and intended to be placed directly or indirectly on a patient's skin.

Hitherto, mortars based on plaster, mixed with a constituent which absorbs medical radiation, were used in order to protect the zone of the patient adjacent to the zone of the patient to be irradiated. By medical irradiation or medical radiation, there is to be understood any irradiation of the type comprising X, $\alpha$, $\beta$ or $\gamma$ rays.

It is known to use barium sulphate as the absorbing constituent.

The positioning of a mortar based on plaster and barium sulphate requires working by hand and with a trowel, since the mortar in the viscous state must be applied by hand and used on the skin of the patient, so that it has an even thickness calculated as a function of the position and of the nature of the irradiation zone. Very frequently, the thickness of the mortar applied cannot be kept constant and the layer applied always shows some unevenness which, after the mortar has set, cannot be corrected.

It is obvious that the application of the mass of plaster-based mortar is a dirty and unpleasant operation for the medical staff and the patient.

It is an object of the present invention to overcome the abovementioned disadvantages and to produce a protective screen which can be applied directly or indirectly to a patient's skin, that is to say ready for use without requiring any unpleasant and long preparation, and which has a perfectly continuous surface.

According to the invention there is provided a mortar based protective screen, for radiological purposes and intended to be placed directly or indirectly on a patient's skin, comprising: a flexible and leakproof jacket, two parallel walls to said jacket; a side wall joining the said two parallel walls and having a surface area small relative to that of each parallel wall; at least one settable resin within said jacket; a fine particulate filler of at least one substance which absorbs medical radiation and is evenly mixed with the said resin; and a window permeable to medical radiation and positioned to permit radiation to pass between the parallel walls of the jacket.

A curing agent may be brought into contact with the settable resin, inside the jacket, and mixed with the contents of the jacket in order that the curing agent reacts with all the thermosetting resin.

This jacket, still in the malleable state, is then applied to the zone of the patient to be treated, taking good care that the zone to be irradiated coincides accurately with the window in the jacket.

A flat metal plate may be applied to the free face of the jacket parallel to the patient's body in order to shape the synthetic mass present inside the jacket by flattening. The plate is removed after the mass has hardened to form a synthetic mortar.

It can thus be seen that, with the screen of this invention, there is no longer any contact between the product and its handler or the patient, and that moreover, after irradiation, this jacket can be removed easily from the patient.

If the temperature is too high during the hardening of the synthetic mortar it is advantageous to place a flexible heat insulating mass, for example a sheet of foam rubber, on that side of the jacket which faces the patient.

Figure 2:
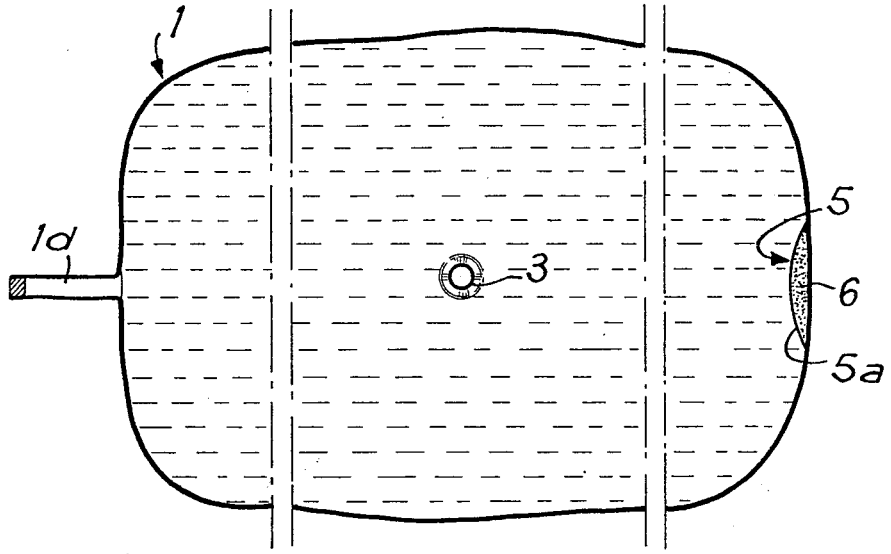
Figure 3:
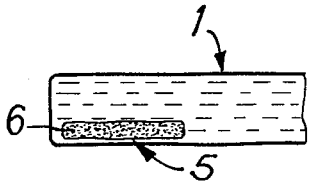
Figure 4:
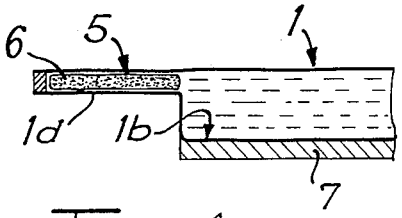

In order that the present invention may more readily be understood, the following description is given merely by way of example, with reference to the accompanying drawing in which:

FIGS. 1 and 2 represent a side view and a plan view, respectively, of the protective screen according to the invention; and FIGS. 3 and 4 show partial side views of two further embodiments of the protective screen according to the invention.

The mortar-based protective screen for radiological purposes is shown in FIG. 1 as comprising a jacket 1 made of plastics material of the polyamide or elastomer type, or of any other suitable material which is leakproof and inert towards the human body, and is intended to be placed, directly or indirectly, on the patient's skin.

Thus it is also possible to use a plasticised fabric to produce the jacket. This jacket 1 comprises two walls 1*a* and 1*b* which extend parallel to one another and have a surface area which is very large relative to that of the side wall 1*c* joining those two parallel walls 1*a* and 1*b*. As shown in FIG. 1, the cross-section of the jacket comprising walls 1*a* and 1*b* and the side wall 1*c* is, for example, of rectangular shape.

This jacket 1 is filled with (a) a thermosetting resin, for example of the epoxy, polyester or phenolic type, and with (b) a fine particulate filler of at least one substance which absorbs medical radiation. This fine particulate filler is evenly mixed with the said resin and consists of barium sulphate, antimony oxide, silica or lead oxide, or preferably a mixture of at least two of these components.

The diameter of the fine particles forming the filler is of the order of a few microns to a few hundred microns.

The mixture of thermosetting resin and filler is referenced 2 in FIGS. 1 to 4.

A window 3, permeable to medical radiation, is provided preferably in the centre of the jacket and extends between the two parallel walls 1*a* and 1*b* of the jacket 1.

It is advantageous to produce this window 3 by means of an elongate solid portion which is made of a material such as polyethylene which is permeable to medical radiation, and the window comprises two parallel end faces one of which is preferably firmly fixed, for example by welding or gluing, to one of the parallel walls 1*a* and 1*b* of the jacket 1. The height of this elongate portion 3 is substantially the same as the width of the side wall 1*c*.

Furthermore, it is possible to use the height of this elongate portion 3 as a guide in order to determine the appropriate width of the side wall 1*c*.

At its side, the jacket 1 carries a tubular portion 1*d*, which, on one side, communicates with the inside of the jacket, and which, at its free end, is generally sealed. When the sealed end of the portion has been cut, it is possible to use this portion to introduce the necessary amount of curing agent inside the jacket. Of course, while the contents of the jacket are being mixed, the resulting aperture must be closed, for example by means of a surgical clamp which presses against the two folded-over branches of the tubular portion.

It is also possible to place the curing agent too, beforehand, inside the jacket 1. In this case, in order to avoid premature reaction, the curing agent can be contained within a pouch or sachet which can be opened by rupturing and is located inside the jacket. This rupturable pouch or sachet has been indicated diagrammatically at 5 in FIGS. 1 to 4.

In a first embodiment, the curing agent 6 is contained in an elongate sachet 5, placed either directly inside the jacket or inside the tubular extension 1*d* of this jacket 1. The rupturable sachet 5 is partially fixed to the inside face of the jacket 1 or of the tubular extension.

When the sachet 5 is placed in the tubular extension 1*d*, the join between the sachet and the tubular extension is made in the sealing zone of this tubular extension and this sealing can, for example, be effected by welding or gluing.

In the embodiment represented in FIGS. 1 and 2, the rupturable sachet consists partially of a rupturable sheet 5*a* covering the curing agent 6, and partially of a part of the jacket 1 to which the edge of the rupturable sheet 5*a* is welded.

The jacket of the protective screen may, for example, measure 30 cm. by 30 cm. in plan view, and may have a height of the order of a few centimetres, for example 3 cm.

A constituent of the composition 2 may be polyepoxides which are organic compounds containing more than one

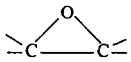

group. Such polyepoxides can be saturated or unsaturated; aliphatic, cycloaliphatic, aromatic or heterocyclic; can be substituted, if so desired, by substituents such as chlorine atoms, hydroxyl groups, ether radicals and the like; and can also be monomeric or polymeric.

In addition to the polyepoxides described above, diluents or elasticising agents, containing at least 10 and preferably at least 12 carbon atoms, may be added to the compositions. Examples of these agents include, amongst others, pine oil, pine oil distillates, tar, bitumens, polythiopolymercaptans, polyamides, aromatic chlorinated compounds, polyesters, monomeric phthalate esters, long chain acids and long chain compounds containing epoxy groups, and their mixtures.

The composition 2 hardens under the action of a curing agent. In some cases, the elasticising agent may contain active hydrogen and can also serve as a curing agent. In other cases, it may be necessary to add an elasticising agent to the curing agent. Suitable curing agents containing epoxy groups may be acidic, neutral or alkaline. Examples of these agents are, amongst others, alkalis, carboxylic acids or anhydrides, Friedel-Crafts halogenated compounds, amino compounds, for example ethylene-diamine, addition products of amines and epoxides, and amide derivatives.

The proportions, relative to the binder, vary greatly as a function of the curing agent used; for example, quantities from a few % to 300 or 400% by weight can be employed.

The unsaturated polyesters to be added to the composition 2 are organic compounds prepared in a manner which is in itself known from unsaturated $\alpha,\beta$-dicarboxylic acids or their anhydrides, or optionally from saturated dicarboxylic acids, and from polyols, or mixed with a solution of an unsaturated polyester in vinyl and/or allyl monomers. It is also known that it is possible to prepare polyesters from polyols and from acids or their esterifiable derivatives by using, as the acid components, benzene-1-amino or 1-alkylamino-3,5-dicarboxylic acids or their lower alkyl esters. Either of the two reactions takes place equally well, for example, in the presence of 10 to 25% by weight of styrene.

The copolymerisation of unsaturated esters with vinyl compounds and mainly styrene is carried out in the presence of catalysts which form free radicals. Peroxides, for example benzoyl peroxide, lauryl peroxide, cumene hydroperoxide and the like, and certain aldehyde, ketone, diketone or amine compounds are generally used as catalysts which form free radicals. It is also possible to use polymerisation initiators based on metal salts or amines.

These catalysts are used in amounts of the order of 0.01 to 5% by weight.

The proportion of radiologically inert particles present in the composition 2 must be at least 25% by weight of the total mixture of the binder and elasticising agents, and preferably between 50 and 1,000% by weight or, even better, between 100 and 400% by weight of the said total mixture.

In a first embodiment the jacket contains, as constituents for the synthetic mortar, the following components:

| | | |
|---|---|---|
| polyester resin of type No. 8,000 | 100 | g. |
| polyester resin of type No. 8,130 | 20 | g. |
| precipitated barium sulphate | 100 | g. |
| antimony oxide as a fine powder | 20 | g. |
| silica as a fine powder | 10 | g. |
| curing agent, methyl ethyl ketone peroxide | 2 | g. |

In a second embodiment the jacket contains, as constituents for the synthetic mortar, the following components:

| | | |
|---|---|---|
| epoxy resin | 100 | g. |
| diglycidyl-ethyl | 10 | g. |
| pine oil | 10 | g. |
| curing agent, diethylene-triamine | 9 | g. |
| precipitated barium sulphate | 100 | g. |
| lead oxide | 20 | g. |
| silica as a fine powder | 10 | g. |

It is advantageous not to use jackets which are thicker than 6 cm. and, in the case where the protective screen must have a greater thickness, it is preferable to superpose several jackets each having a height of less than 6 cm.

Where the synthetic mortar composition hardens exothermically, and thus produces a temperature gradient which is too high for the skin of the patient to tolerate, a flexible and heat insulating mass, for example a sheet 7 of foam rubber may advantageously be provided on the wall 1*b* of the jacket facing the patient. This sheet 7 can be positioned outside or inside the wall of the jacket 1. If it is positioned inside the jacket 1, at least its edge must then adhere, in a leak-proof manner, to the wall 1*b*. On the other hand, if the sheet 7 is provided on the outer face of the jacket 1, it can then be fixed to the wall 1*b* by only a few welding or gluing points, and this further improves the heat insulation.

It should be understood that the above description is given by way of example only and the scope of the invention should not be considered as being restricted to the specific details given. Modifications can readily be incorporated without departing from the scope of the invention as defined in the following claims.

I claim:

1. A mortar based protective screen, for radiotherapeutic purposes and placed on a patient's skin, comprising: a flexible and leakproof jacket having two parallel walls; a side wall joining the said two parallel walls and having a surface area small relative to that of each parallel wall; at least one settable resin within said jacket; a fine particulate filler of at least one substance which absorbs radiotherapeutic radiation and is evenly mixed with the said resin; and a window permeable to radiotherapeutic radiation and positioned to permit radiation to pass between the parallel walls of the jacket.

2. A protective screen as set forth in claim 1, wherein the window consists of an elongate solid portion made from a material which is permeable to radiotherapeutic radiation and comprises two parallel end faces, one of which end faces is firmly fixed to the said jacket.

3. A protective screen as set forth in claim 2, wherein said elongate portion is cylindrical and has its base bonded to the jacket.

4. A protective screen as set forth in claim 2, wherein said elongate portion is made of polyethylene.

5. A protective screen as set forth in claim 1, and including at the side of the jacket a tubular portion sealed at its free end and adapted to allow a curing agent to be introduced inside the jacket once the sealed end has been opened.

6. A protective screen as set forth in claim 1, and including a rupturable pouch within the jacket, and a curing agent within said pouch for mixing with the thermosetting resin immediately before use of the jacket as a protective screen.

7. A protective screen as set foth in claim 6, wherein said rupturable pouch is partially fixed to the inside face of the jacket.

8. A protective screen according to claim 7, wherein the pouch is fixed to the interior of said tubular portion.

9. A protective screen as set forth in claim 6, wherein said rupturable pouch consists partially of a rupturable sheet and partially of a part of the jacket, the rupturable sheet being welded at its edge to the said jacket and serving to cover the curing agent.

10. A protective screen as set forth in claim 1, wherein the settable resin is a resin selected from the group consisting of epoxy, polyester and phenolic resins.

11. A protective screen as set forth in claim 1, wherein said substance which absorbs radiotherapeutic radiation consists of at least one compound selected from the group consisting of barium sulphate, antimony oxide, silica and lead oxide, and is in the form of a fine powder.

12. A protective screen as set forth in claim 11, wherein said substance consists of a mixture of at least two compounds selected from the group consisting of barium sulphate, antimony oxide, silica and lead oxide.

13. A protective screen as set forth in claim 1, wherein said jacket is formed of a material selected from the group consisting of a polyamide and an elastomer.

14. A protective screen as set forth in claim 1, wherein the jacket consists of a plasticised fabric.

15. A protective screen as set forth in claim 1, and including a flexible heat insulating mass provided on that side of the jacket which in use, will face the patient.

16. A protective screen according to claim 15, wherein said heat insulating mass is a sheet of foam rubber.

* * * * *